US008286733B2

(12) United States Patent
Tulloch et al.

(10) Patent No.: US 8,286,733 B2
(45) Date of Patent: Oct. 16, 2012

(54) ROTARY STEERABLE TOOL

(75) Inventors: Rory McCrae Tulloch, Aberdeen (GB); Colin Robert Blair, Aberdeen (GB); John Oates, Aberdeen (GB)

(73) Assignee: General Electric Company, Schenectady, NY (US)

( * ) Notice: Subject to any disclaimer, the term of this patent is extended or adjusted under 35 U.S.C. 154(b) by 279 days.

(21) Appl. No.: 12/766,132

(22) Filed: Apr. 23, 2010

(65) Prior Publication Data

US 2011/0259645 A1 Oct. 27, 2011

(51) Int. Cl.
*E21B 7/08* (2006.01)

(52) U.S. Cl. ..... 175/76; 175/320

(58) Field of Classification Search ..... 175/73, 175/76, 320

See application file for complete search history.

(56) References Cited

U.S. PATENT DOCUMENTS

| | | | | |
|---|---|---|---|---|
| 6,892,830 | B2 * | 5/2005 | Noe et al. | 175/61 |
| 6,948,572 | B2 * | 9/2005 | Hay et al. | 175/61 |
| 7,306,058 | B2 * | 12/2007 | Cargill et al. | 175/76 |
| 7,543,658 | B2 * | 6/2009 | Russell et al. | 175/73 |

FOREIGN PATENT DOCUMENTS

| | | | |
|---|---|---|---|
| GB | 2438729 | B | 8/2008 |
| WO | 2008145950 | A | 12/2008 |

* cited by examiner

*Primary Examiner* — William P Neuder
(74) *Attorney, Agent, or Firm* — Armstrong Teasdale LLP

(57) ABSTRACT

A rotary steerable tool is provided for use with a drilling apparatus. The rotary steerable tool includes at least a first portion that includes an outer housing, a rotary shaft extending through the outer housing, a drive clutch coupled to the rotary shaft, and a sensor coupled to the rotary shaft. The drive clutch is movable between an engaged configuration and a disengaged configuration. The sensor is configured to identify whether the drive clutch is in at least one of the engaged configuration and the disengaged configuration.

17 Claims, 5 Drawing Sheets

ROTARY STEERABLE TOOL

BACKGROUND OF THE INVENTION

The subject matter disclosed herein relates generally to directional drilling and, more specifically, to a rotary steerable tool.

Known rotary steerable tools include a plurality of portions that are treadably coupled along an axis of the rotary steerable tool. At least some known rotary steerable tools include a clutch that includes a plurality of pins to engage an outer housing with a rotary drive shaft extending therethrough. More specifically, for at least some known rotary steerable tools, the clutch is mounted to a lower portion of the drive shaft, and a magnetic orientation sensor, which is configured to detect whether the clutch is engaged, is coupled to an upper portion of the drive shaft, thereby positioning a threaded coupling between the clutch and the sensor. As such, high torque and/or vibrations may cause the clutch and/or the sensor to become misaligned relative to each other.

BRIEF DESCRIPTION OF THE INVENTION

In one aspect, a drilling portion is provided for use with a rotary steerable tool. The drilling portion includes an outer housing, a rotary shaft extending through the outer housing, a drive clutch coupled to the rotary shaft, and a sensor coupled to the rotary shaft. The drive clutch is movable between an engaged configuration and a disengaged configuration. The sensor is configured to identify whether the drive clutch is in at least one of the engaged configuration and the disengaged configuration.

In another aspect, a rotary steerable tool is provided for use with a drilling apparatus. The rotary steerable tool includes at least a first portion that includes an outer housing, a rotary shaft extending through the outer housing, a drive clutch coupled to the rotary shaft, and a sensor coupled to the rotary shaft. The drive clutch is movable between an engaged configuration and a disengaged configuration. The sensor is configured to identify whether the drive clutch is in at least one of the engaged configuration and the disengaged configuration.

In yet another aspect, a drilling apparatus is provided. The drilling apparatus includes a motor and a rotary steerable tool coupled to the motor. The rotary steerable tool includes at least a first portion that includes an outer housing, a rotary shaft extending through the outer housing, a drive clutch coupled to the rotary shaft, and a sensor coupled to the rotary shaft. The drive clutch is movable between an engaged configuration and a disengaged configuration. The sensor is configured to identify whether the drive clutch is in at least one of the engaged configuration and the disengaged configuration.

DETAILED DESCRIPTION OF THE INVENTION

The subject matter described herein relates generally to directional drilling. More specifically, the subject matter described herein relates to a rotary steerable tool. In one embodiment, the rotary steerable tool includes a tubular housing, a rotary shaft extending through the tubular housing, a drive clutch coupled to the rotary shaft, and an sensor coupled to the same rotary shaft as is coupled to the drive clutch, wherein the sensor is configured to identify whether the drive clutch is in an engaged configuration or a disengaged configuration.

As used herein, an element or step recited in the singular and proceeded with the word "a" or "an" should be understood as not excluding plural elements or steps unless such exclusion is explicitly recited. Furthermore, references to "one embodiment" of the present invention are not intended to be interpreted as excluding the existence of additional embodiments that also incorporate the recited features.

Figure 1:
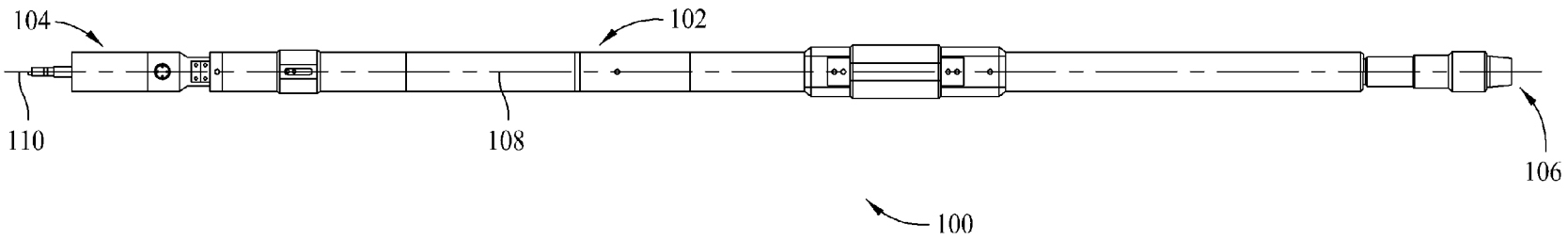
FIG. 1 is a perspective illustration of a rotary steerable tool that may be used with a drilling apparatus.
Figure 2:
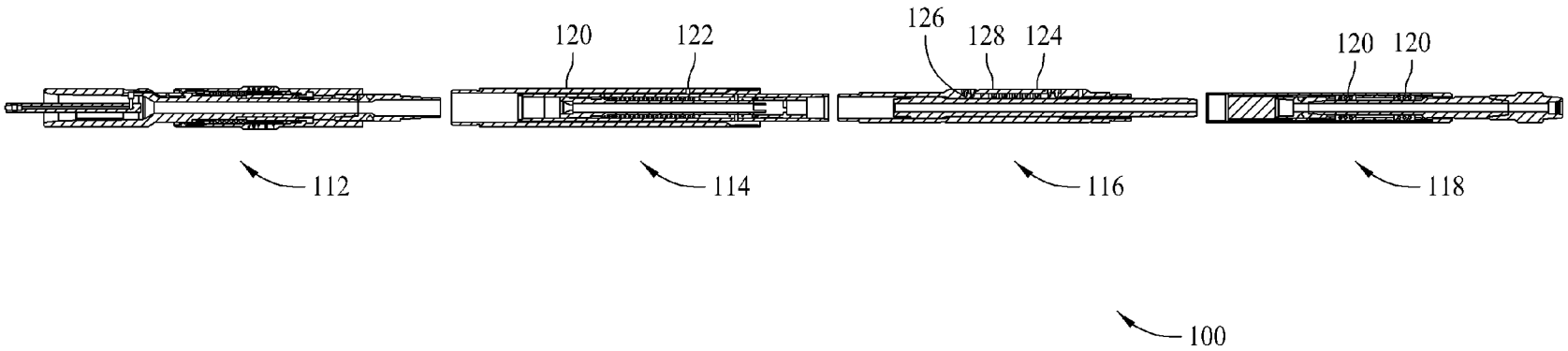
FIG. 2 is a cross-sectional illustration of an exploded view of the rotary steerable tool shown in FIG. 1.

FIGS. 1 and 2 show a rotary steerable tool 100 usable with a drilling apparatus (not shown) to drill a borehole (not shown). In the exemplary embodiment, rotary steerable tool 100 is coupleable to a motor (not shown) for rotation of at least a portion of rotary steerable tool 100. In the exemplary embodiment, rotary steerable tool 100 includes an outer housing 102 and a rotary drive shaft 104 extending therethrough. In the exemplary embodiment, a drill bit (not shown) is coupleable to a lower end 106 of rotary drive shaft 104. In the exemplary embodiment, rotary drive shaft 104 facilitates transmitting torque from a surface (not shown) of the borehole to the drill bit. In the exemplary embodiment, rotary drive shaft 104 includes a hollow passage 108 defined therethrough that facilitates channeling drilling fluid to the drill bit.

In the exemplary embodiment, outer housing 102 includes, threadably coupled in serial arrangement along a longitudinal axis 110 of rotary steerable tool 100, an upper housing 112, a valve housing 114, a blade housing 116, and a lower housing 118. In the exemplary embodiment, upper housing 112, valve housing 114, blade housing 116, and/or lower housing 118 includes a plurality of bearings 120 located therein that facilitate selectively rotating outer housing 102 about longitudinal axis 110 with rotary drive shaft 104. Upper housing 112 is described in further detail below.

In the exemplary embodiment, valve housing 114 includes a piston 122 that is slidably mounted therein. More specifically, in the exemplary embodiment, piston 122 is selectively slidable to move along longitudinal axis 110 between a first axial position and a second axial position.

In the exemplary embodiment, blade housing 116 includes a plurality of steering blades 124 positioned about a circumference thereof. In the exemplary embodiment, steering blades 124 are slidably coupled via a plurality of pusher pistons 126 that are configured to communicate with piston 122. In the exemplary embodiment, steering blades 124 are movable between a retracted position, in which at least one steering blade 124 does not engage a wall (not shown) of the borehole, and an extended position, in which at least one steering blade 124 engages the wall.

In the exemplary embodiment, at least one steering blade 124 is biased inward towards the refracted position by a leaf spring 128, and at least one steering blade 124 is pushed outward towards the extended position by an increase in drilling fluid pressure produced by piston 122 and/or pusher pistons 126. More specifically, in the exemplary embodiment, when piston 122 is in the first axial position, at least one steering blade 124 moves towards the extended position, and when piston 122 is in the second axial position, at least one steering blade 124 moves towards the retracted position.

Figure 3:
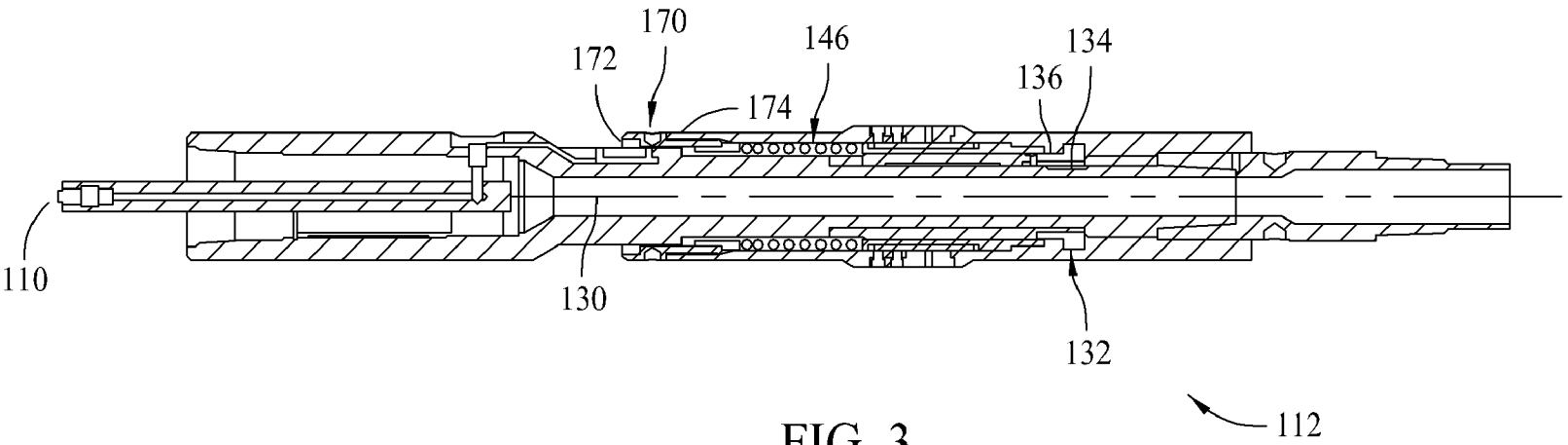
FIG. 3 is a cross-sectional illustration of a portion of the rotary steerable tool shown in FIG. 1.
Figure 4:
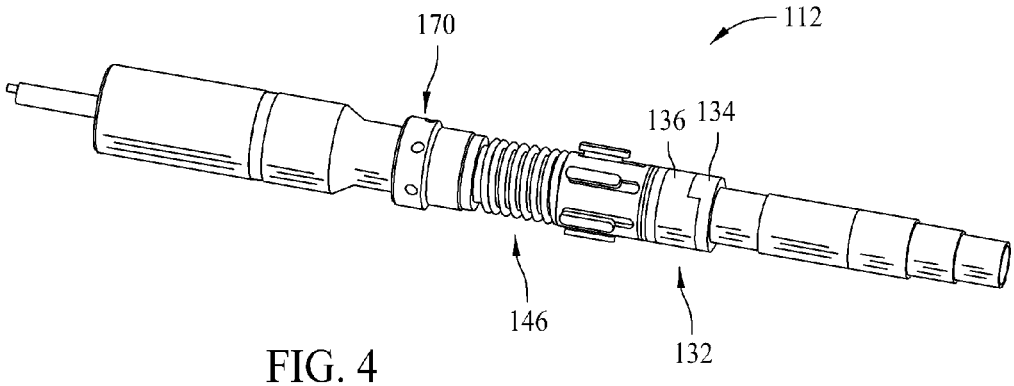
FIG. 4 is a perspective illustration of the portion shown in FIG. 3 in an engaged configuration.
Figure 5:
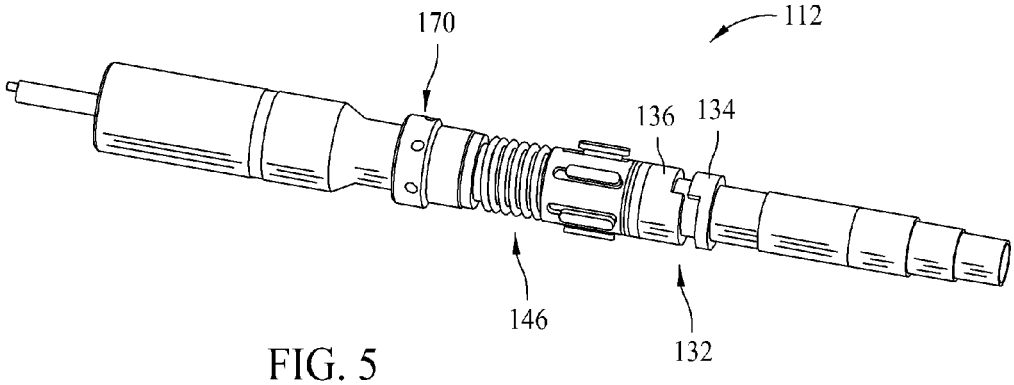
FIG. 5 is a perspective illustration of the portion shown in FIG. 3 in a disengaged configuration.

FIG. 3 shows upper housing 112 including a first portion 130 of rotary drive shaft 104 extending therethrough. In the exemplary embodiment, first portion 130 includes a drive clutch 132 that is configured to releasably couple outer housing 102 to rotary drive shaft 104 for rotation therewith. More specifically, in the exemplary embodiment, drive clutch 132 is movable between an engaged configuration, as shown in FIG. 4 in which outer housing 102 rotates with rotary drive shaft 104, and a disengaged configuration, as shown in FIG. 5 in which rotary drive shaft 104 rotates independent from outer housing 102.

In the exemplary embodiment, drive clutch 132 includes an inner ring 134 that is coupled to rotary drive shaft 104 and an outer ring 136 that is substantially complementary to inner ring 134. In the exemplary embodiment, inner ring 134 is compressed against rotary drive shaft 104 to facilitate maintaining a relative positioning of inner ring 134 about rotary drive shaft 104. Additionally, in the exemplary embodiment, inner ring 134 and/or rotary drive shaft 104 are keyed to further facilitate maintaining the relative positioning of inner ring 134 about rotary drive shaft 104 while rotary steerable tool 100 is in use.

Figure 6:
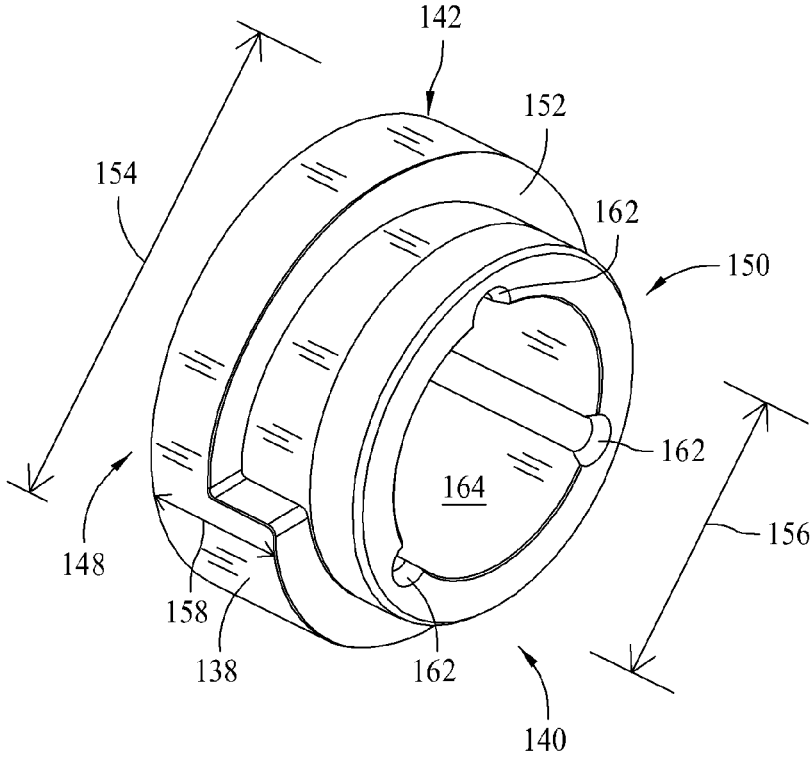
FIG. 6 is a perspective illustration of a first ring of a drive clutch that may be used with the portion shown in FIG. 3.
Figure 7:
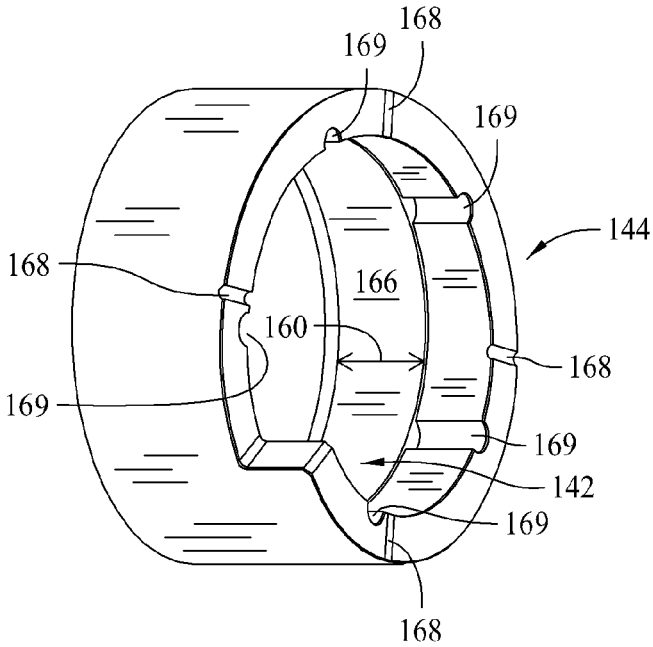
FIG. 7 is a perspective illustration of a second ring of a drive clutch that may be used with the first ring shown in FIG. 6.

In the exemplary embodiment, as shown in FIG. 6, inner ring 134 has a first configuration, and, as shown in FIG. 7, outer ring 136 has a second configuration that is complementary to the first configuration. In the exemplary embodiment, inner ring 134 and outer ring 136 each has a single-toothed configuration. More specifically, in the exemplary embodiment, a first tooth 138 is formed on an upper end 140 of inner ring 134, and a second tooth 142 is formed on a lower end 144 of outer ring 136 such that second tooth 142 is configured to engage and/or disengage first tooth 138 when inner ring 134 is rotated away from outer ring 136. It should be understood that inner ring 134 and/or outer ring 136 may have any suitable number of teeth that enables drive clutch 132 to function as described herein. In the exemplary embodiment, inner ring 134 is biased away from outer ring 136 towards the disengaged configuration by a coil spring 146, and inner ring 134 is selectively rotated towards the engaged configuration to engage outer ring 136.

In the exemplary embodiment, inner ring 134 includes a base portion 148, a top portion 150, and a step 152 defined therebetween. In the exemplary embodiment, base portion 148 has a first diameter 154, and top portion 150 has a second diameter 156 that is less than first diameter 154. In the exemplary embodiment, step 152 extends substantially perpendicularly from longitudinal axis 110 about a circumference of inner ring 134. More specifically, in the exemplary embodiment, step 152 is defined by a helically swept cut that is substantially perpendicular to longitudinal axis 110 starting approximately 43.0 mm from upper end 140 and finishing approximately 18.0 mm from upper end 140, thereby providing first tooth 138 with a height 158 of approximately 25.0 mm. Similarly, lower end 144 of outer ring 136 includes a helically swept cut that is substantially perpendicular to longitudinal axis 110 to provide second tooth 142 with a height 160 of approximately 25.0 mm.

In the exemplary embodiment, inner ring 134 and/or outer ring 136 include a plurality of slots 162 to ensure that fluid does not become trapped inside inner ring 134 and/or outer ring 136. In the exemplary embodiment, inner ring 134 includes slots 162 defined in an inner surface 164 of inner ring 134. More specifically, in the exemplary embodiment, three slots 162 extend along longitudinal axis 110 and are positioned equidistantly from each other or approximately 120.0° apart. Similarly, in the exemplary embodiment, outer ring 136 includes slots 162 defined in an inner surface 166 of outer ring 136. More specifically, in the exemplary embodiment, five slots 162 extend along longitudinal axis 110 and are positioned equidistantly from each other or approximately 72.0° apart. Additionally, outer ring 136 includes a second plurality of slots 168 that are defined in lower end 144. In the exemplary embodiment, four slots 168 extend radially or substantially perpendicularly from longitudinal axis 110 and are positioned equidistantly from each other or approximately 90.0° apart.

In the exemplary embodiment, upper housing 112 also includes a sensor housing 170 including a sensor 172 mounted therein. In the exemplary embodiment, sensor housing 170 and/or sensor 172 is coupled to the same portion of rotary drive shaft 104 as is coupled to drive clutch 132. As such, there are no threaded connections or couplings that are positioned between drive clutch 132 and sensor 172, thereby reducing a likelihood that drive clutch 132 and/or sensor 172 will be misaligned with respect to each other. In the exemplary embodiment, sensor housing 170 is sized to house sensor 172 and/or any or all wirings coupled to sensor 172.

In the exemplary embodiment, sensor 172 is configured to identify whether drive clutch 132 is in the engaged configuration and/or the disengaged configuration. In the exemplary embodiment, sensor 172 is a magnetic sensor, such as a Hall effect sensor, that is configured to detect a configuration of drive clutch 132. More specifically, in the exemplary embodiment, at least one magnet 174 is positioned on first portion 130 of rotary drive shaft 104, upper housing 112, and/or drive clutch 132 to provide a signal indicating a configuration of drive clutch 132. The signal may be used to provide a continuous indication of the configuration of first portion 130, upper housing 112, and/or drive clutch 132, even while rotary steerable tool 100 is in use.

During operation, inner ring 134 is rotated relative to outer ring 136 to engage inner ring 134 with outer ring 136 such that drive clutch 132 is in the engaged configuration. While in the engaged configuration, outer housing 102 is configured to rotate with rotary drive shaft 104. More specifically, in the exemplary embodiment, steering blades 124, which are coupled to a portion of outer housing 102 that is different from first portion 130, rotate with rotary drive shaft 104 when drive clutch 132 is in the engaged configuration. In the exemplary embodiment, sensor 172 provides a signal indicating a configuration of drive clutch 132, thereby providing feedback to a user.

To rotate rotary drive shaft 104 independent of outer housing 102, inner ring 134 is rotated relative to outer ring 136 to disengage inner ring 134 from outer ring 136 such that drive clutch 132 is in the disengaged configuration. As such, steering blades 124, which are coupled to the portion of outer housing 102 that is different from first portion 130, do not rotate while rotary drive shaft 104 rotates independent of outer housing 102 when drive clutch 132 is in the disengaged configuration. In the exemplary embodiment, sensor 172 provides a signal indicating the configuration of drive clutch 132, thereby providing feedback to a user.

Exemplary embodiments of methods and systems are described and/or illustrated herein in detail. The exemplary methods and systems facilitate aligning a drive clutch and/or a sensor and coupling an outer housing to the rotary shaft, thereby reducing a cost associated with directional drilling. The exemplary systems and methods are not limited to the specific embodiments described herein, but rather, components of each system and/or steps of each method may be utilized independently and separately from other components and/or method steps described herein. Each component and each method step may also be used in combination with other components and/or method steps.

This written description uses examples to disclose certain embodiments of the present invention, including the best mode, and also to enable any person skilled in the art to practice those certain embodiments, including making and using any devices or systems and performing any incorporated methods. The patentable scope of the present invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A drilling portion for use with a rotary steerable tool comprising:

an outer housing;

a rotary shaft extending through said outer housing;

a drive clutch coupled to said rotary shaft, wherein said drive clutch is movable between an engaged configuration and a disengaged configuration; said drive clutch comprises a first ring and a second ring oriented such that said first ring engages said second ring when said drive clutch is in the engaged configuration, and said first ring does not engage said second ring when said drive clutch is in the disengaged configuration; and a sensor coupled to said rotary shaft, wherein said sensor is configured to identify whether said drive clutch is in at least one of the engaged configuration and the disengaged configuration.

2. A drilling portion in accordance with claim 1, wherein said orientation location sensor is a Hall effect sensor.

3. A drilling portion in accordance with claim 1, wherein said outer housing is coupleable to a second outer housing comprising at least one steering pusher that is configured to rotate when said drive clutch is in the engaged configuration, and not rotate when said drive clutch is in the disengaged configuration.

4. A drilling portion in accordance with claim 1, wherein each of said first ring and said second ring comprises a single tooth configuration.

5. A drilling portion in accordance with claim 1, wherein at least one of said first ring and said second ring comprises a plurality of slots configured to channel fluid therethrough.

6. A rotary steerable tool for use with a drilling apparatus, said rotary steerable tool comprising at least a first portion that comprises an outer housing, a rotary shaft extending through said outer housing, a drive clutch coupled to said rotary shaft, and a sensor coupled to said rotary shaft, wherein said drive clutch is movable between an engaged configuration and a disengaged configuration, and wherein said drive clutch comprises a first ring and a second ring oriented such that said first ring engages said second ring when said drive clutch is in the engaged configuration, and said first ring does not engage said second ring when said drive clutch is in the disengaged configuration, and wherein said sensor is configured to identify whether said drive clutch is in at least one of the engaged configuration and the disengaged configuration.

7. A rotary steerable tool in accordance with claim 6, wherein said orientation location sensor is a Hall effect sensor.

8. A rotary steerable tool in accordance with claim 6 further comprising a second portion that comprises a plurality of bearings that are configured to rotate said outer housing.

9. A rotary steerable tool in accordance with claim 6 further comprising a second portion that comprises at least one steering pusher that is configured to rotate when said drive clutch is in the engaged configuration, and not rotate when said drive clutch is in the disengaged configuration.

10. A rotary steerable tool in accordance with claim 6, wherein each of said first ring and said second ring comprises a single tooth configuration.

11. A rotary steerable tool in accordance with claim 6, wherein at least one of said first ring and said second ring comprises a plurality of slots configured to channel fluid therethrough.

12. A drilling apparatus comprising:

a motor; and a rotary steerable tool coupled to said motor, said rotary steerable tool comprising at least a first portion that comprises an outer housing, a rotary shaft extending through said outer housing, a drive clutch coupled to said rotary shaft, and a sensor coupled to said rotary shaft, wherein said drive clutch is movable between an engaged configuration and a disengaged configuration, and wherein said drive clutch comprises a first ring and a second ring oriented such that said first ring engages said second ring when said drive clutch is in the engaged configuration, and said first ring does not engage said second ring when said drive clutch is in the disengaged configuration, and wherein said sensor is configured to identify whether said drive clutch is in at least one of the engaged configuration and the disengaged configuration.

13. A drilling apparatus in accordance with claim 12, wherein said orientation location sensor is a Hall effect sensor.

14. A drilling apparatus in accordance with claim 12 further comprising a second portion that comprises a plurality of bearings that are configured to rotate said outer housing.

15. A drilling apparatus in accordance with claim 12 further comprising a second portion that comprises at least one steering pusher that is configured to rotate when said drive clutch is in the engaged configuration, and not rotate when said drive clutch is in the disengaged configuration.

16. A drilling apparatus in accordance with claim 12, wherein each of said first ring and said second ring comprises a single tooth configuration.

17. A drilling apparatus in accordance with claim 12, wherein at least one of said first ring and said second ring comprises a plurality of slots configured to channel fluid therethrough.

* * * * *